US008095058B2

(12) United States Patent
Chiba

(10) Patent No.: US 8,095,058 B2
(45) Date of Patent: Jan. 10, 2012

(54) CONVEYOR-BELT APPARATUS AND IMAGE HEATING APPARATUS CHANGING THE BELT TENSION IN ACCORDANCE WITH THE MOVING STATE OF THE BELT

(75) Inventor: Takatoshi Chiba, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 553 days.

(21) Appl. No.: 12/252,744

(22) Filed: Oct. 16, 2008

(65) Prior Publication Data

US 2009/0114510 A1 May 7, 2009

(30) Foreign Application Priority Data

Nov. 2, 2007 (JP) ..... 2007-285694

(51) Int. Cl.
*G03G 15/20* (2006.01)

(52) U.S. Cl. ..... 399/329

(58) Field of Classification Search ..... 399/162, 399/165, 302, 303, 329
See application file for complete search history.

(56) References Cited

U.S. PATENT DOCUMENTS

| | | | | |
|---|---|---|---|---|
| 7,480,480 | B2 | 1/2009 | Endo et al. | |
| 7,647,006 | B2 * | 1/2010 | Nakamura et al. | 399/165 |
| 7,810,633 | B2 * | 10/2010 | Okamoto et al. | 399/165 |
| 7,860,440 | B2 * | 12/2010 | Miyata et al. | 399/329 |
| 7,957,673 | B2 * | 6/2011 | Geyling et al. | 399/165 |
| 2007/0059061 | A1 | 3/2007 | Katayama et al. | |
| 2007/0059064 | A1 | 3/2007 | Okuda et al. | |

FOREIGN PATENT DOCUMENTS

| | | |
|---|---|---|
| JP | 4-104180 | 4/1992 |
| JP | 2004-341346 | 12/2004 |

* cited by examiner

*Primary Examiner* — William J Royer
(74) *Attorney, Agent, or Firm* — Fitzpatrick, Cella, Harper & Scinto

(57) ABSTRACT

A conveyor-belt apparatus includes a belt, a supporting member that rotatably supports the belt, a moving unit that displaces at least one end of the supporting member in a longitudinal direction to move the belt in the longitudinal direction, and a tension changing unit that changes a tension of the belt in accordance with the moving state of the belt in the longitudinal direction when the moving unit displaces the end of the supporting member.

12 Claims, 18 Drawing Sheets

CONVEYOR-BELT APPARATUS AND IMAGE HEATING APPARATUS CHANGING THE BELT TENSION IN ACCORDANCE WITH THE MOVING STATE OF THE BELT

BACKGROUND OF THE INVENTION

1. Field of the Invention

The present invention relates to a conveyor-belt apparatus in which an endless belt circulates. Further, the present invention relates to an image heating apparatus in which the conveyor-belt apparatus may be applicable to, for example, a fixing device for heating a toner image in an image forming apparatus such as a copying machine or a printer.

2. Description of the Related Art

In general, in the image forming apparatus, a toner image formed on an image bearing member is transferred onto a sheet such as a recording material, and the sheet is conveyed to the fixing device in which the toner image is heated and pressed to be fixed onto the sheet, thereby recording and outputting the image. A typical fixing device is constructed of a roller pair including a heating roller and a pressure roller. A heater is installed inside the heating roller, and the pressure roller is brought into pressure-contact with the heating roller to form a fixing nip portion. The fixing nip portion nips the sheet to heat and apply pressure to the sheet.

By the way, in order to increase the image formation speed as much as possible, and in addition, to output a high definition, high quality image with a high glossiness, a method can be used involving the elongating of the period of time during which the sheet passes through the fixing nip portion as much as possible, thereby fusing the toner sufficiently to soften it. As a method for elongating the passing time period, the diameters of the heating roller and the pressure roller may be enlarged. However, in such a case, the fixing device is enlarged in size, resulting in a problem of enlargement in size of the image forming apparatus main body.

In order to elongate the sheet passing period of time, there is a recent tendency to employ a fixing device in which the fixing nip portion is formed with a belt type in place of a roller type which has been used before. Adoption of the belt type attains suppression of the size enlargement of the fixing device, and in addition, attains a high speed operation, thereby elongating the period of time during which the sheet passes. For example, Japanese Patent Application Laid-Open No. 2004-341346 describes an image forming apparatus and a fixing device, in which a necessary and sufficient nip width is secured in a sheet conveying direction. However, even in the belt type of apparatus, there is the following problem in spite of those advantages.

Either a heating belt or a pressure belt are an endless belt formed in an endless shape. The endless belt exhibits a peculiar behavior during circulation. Specifically, the belt moves alternately to right and left to be misaligned to perform serpentine movement in the belt width direction, which is orthogonal to a circulation direction, resulting in the dropping out of a belt driving roller, likely causing damage at right and left ends of the belt. A solution to these problems is important. Before this, the applicant of the present invention suggested a technology relating to prevention of the belt misalignment (see, for example, Japanese Patent Application Laid-Open No. H04-104180). This relates to a technology which includes a lateral movement control unit for causing a fixing film formed into an endless belt shape to an endless reciprocating motion within a predetermined range in the longitudinal direction, and in which a speed variable unit for varying a lateral speed is provided.

As described above, in the conveyor-belt apparatus in which a belt is passed over two roller members to be circulated, there is a case in which the belt laterally moves alternately to one side and the other side of its intended path to perform serpentine movement during the circulation. In that case, a so-called steering mechanism is operated to perform a return operation control such that the belt moves from the one side to the other side to thereby circulate the belt at a proper position. The steering mechanism refers to a technology in which, when the belt conducts the lateral movement, a rotation shaft of any one of the roller members is operated toward an inclined direction to return the belt which has been misaligned on the one side toward the other side, and this operation is repeated alternately to circulate the belt at the proper position.

However, if the durability of the belt is lowered or the belt is degraded due to use with time, there occurs a variation in friction pressure distribution due to a friction factor ($\mu$) on an inner surface of the belt, resulting in a tendency for the belt to conduct the lateral movement toward a side where the friction pressure is lowered. This tendency of lateral movement becomes marked and the belt finally becomes out of control. The belt, being out of control, comes off from the roller members to drop out or to be damaged, and reaches the end of its life.

In order to prevent the belt from conducting lateral movement toward the side with the lower the friction factor, the steering amount can be increased so that an inclination angle of a roller rotating shaft is increased toward the steering direction. However, as the inclination angle of the roller rotating shaft is increased, there is a need to provide a space for accomodating the inclination. In such a case of the image forming apparatus, which is required to severly limit the space for installing components, it is particularly and significantly disadvantageous. For example, in a case of twin belt fuser (TBF), particularly, there is employed a two-axis steering mechanism using two roller members at an entry of an upstream side in a direction of conveying the recording sheet, and there is a limit to increase the steering amount because the increase of the steering amount affects the behavior of the recording paper.

SUMMARY OF THE INVENTION

It is an object of the present invention to provide a conveyor-belt apparatus in which, while preventing enlargement of the apparatus, lateral movement control of a belt may be properly carried out even if friction pressure distribution is varied due to a friction factor ($\mu$) on an inner surface of the belt. Further, it is another object of the invention to provide an image heating apparatus using such a conveyor-belt apparatus described above.

The present invention provides a conveyor-belt apparatus comprising:

a belt;

a supporting member that rotatably supports the belt;

a moving unit that displaces at least one end of the supporting member in a longitudinal direction to move the belt in the longitudinal direction; and a tension changing unit that changes the tension of the belt in accordance with a moving state of the belt in the longitudinal direction when the moving unit displaces the end of the supporting member.

The present invention provides an image heating apparatus comprising:

a belt for heating a toner image on a recording material;

a supporting member that rotatably supports the belt;

a moving unit that displaces at least one end of the supporting member in a longitudinal direction to move the belt in the longitudinal direction; and a tension changing unit that changes the tension of the belt in accordance with a moving state of the belt in the longitudinal direction when the moving unit displaces the end of the supporting member.

Further features of the present invention will become apparent from the following description of exemplary embodiments with reference to the attached drawings.

DESCRIPTION OF THE EMBODIMENTS

Hereinafter, a description is provided of an exemplary embodiment of each of a conveyor-belt apparatus and a toner image heating apparatus with reference to the accompanying drawings.

(Image Forming Apparatus)

Figure 1:
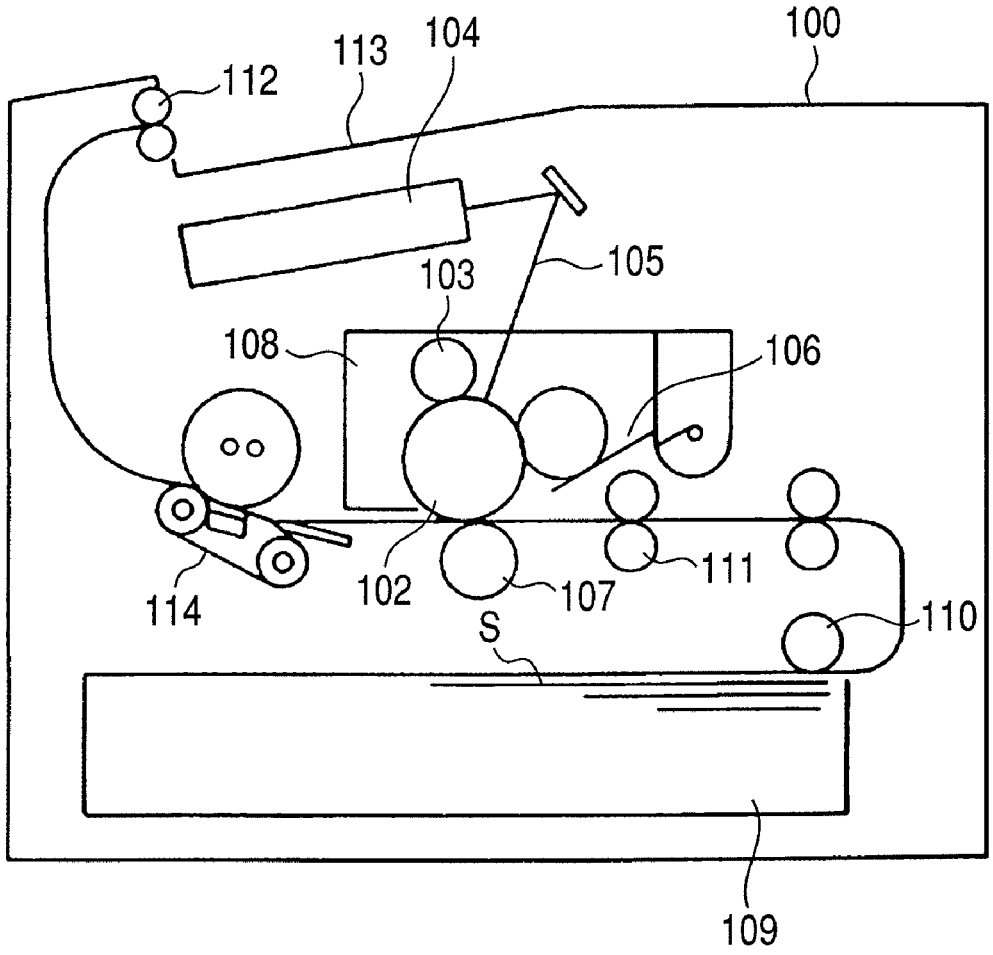
FIG. 1 illustrates a printer main body as a specific example of an image forming apparatus in a first embodiment of a case where a conveyor-belt apparatus according to the present invention is applied to a fixing device of the image forming apparatus.

First, FIG. 1 illustrates a printer employing an electrophotographic process as a specific example in which a toner image heating apparatus according to this embodiment is used as a fixing device. This printer main body 100 is constructed by including an image forming portion for forming a toner image on a sheet (recording paper), a belt type fixing device for fixing the toner image transferred onto the sheet by heat and pressure, and the like.

The image forming portion includes a photosensitive drum 102 as an image bearing member, and the following processing means are arranged in a periphery of the photosensitive drum 102. A charging device 103 as the processing means applies a charging bias voltage to the photosensitive drum 102 to charge a surface of the photosensitive drum 102 in a uniform manner. An exposure device 104 as the processing means irradiates the photosensitive drum 102 with light 105 in accordance with an image to form an electrostatic latent image on the photosensitive drum 102. A developing apparatus 106 as the processing means develops the electrostatic latent image formed by the exposure device 104 to visualize it as a toner image.

On the other hand, sheets S, such as recording paper, are contained in a feed cassette 109 at a lower portion of the printer main body 100, and the sheets S are fed, one by one, by a feed roller 110. Sheets S are conveyed by a registration roller pair 111 in synchronism with the toner image on the photosensitive drum 102. The toner remained on the photosensitive drum 102 is removed by a cleaning apparatus 108 as a cleaning unit.

The toner image formed and carried on the photosensitive drum 102 is electrostatically transferred onto the conveyed sheet S by a transfer roller 107. After that, the sheet S is nipped and conveyed by a fixing device 114 so as to be heated and pressure is applied thereto, so that the toner image on the sheet S is permanently fixed thereto to be output as an image. Then, the sheet S is delivered by a delivery roller pair 112 to a delivery tray 113 provided on an upper portion of the apparatus.

First Embodiment

Next, by referring to FIG. 2 to FIG. 6, a description will be provided of a first embodiment of a case where a conveyor-belt apparatus according to this embodiment is applied to a fixing device 114 as a toner image heating apparatus of this embodiment.

The fixing device 114 includes a heating roller 11 inside of which a halogen heater 12 is mounted. Owing to the heat of the halogen heater 12, the heating roller 11 heats an unfixed toner image transferred onto the sheet S. A pressure belt (endless belt) 13, which constitutes the conveyor-belt apparatus, nips a conveying sheet S by a nip portion between the heating roller (rotary member) 11 and the pressure belt 13 to convey the sheet S while applying pressure to the sheet S at an appropriate nip pressure. The heating roller 11 includes a metal core formed of an aluminum cylindrical pipe having an outer diameter of 56 mm and an inner diameter of 50 mm, for instance, and the halogen heater 12 is provided inside the metal core. On a surface of the metal core, there is provided an elastic layer made of a silicon rubber having a thickness of 2 mm and a hardness (Asker C hardness) of 45 degrees, for instance, and a surface layer of the elastic layer is covered with a PFA or PTFE heat-resistant releasing layer.

The pressure belt 13 is passed over two rollers including a pressure roller 14 being a supporting member and a tension roller 15, and is suspended for its circulation running. The tension roller 15 on the other side performs two functions including a belt steering function and a belt tension enhancing function. With this tension roller 15, the pressure belt 13 is suspended while being imparted with a preset tension of 100 N, for instance. The material for the pressure belt 13 may appropriately be selected as long as it has a heat resistance, and there may be used a material which is formed of a polyimide film having a thickness of 75 μm, a width of 380 mm, and a circumferential length of 200 mm, for instance, and is coated with a silicon rubber having a thickness of 300 μm, for instance.

Further, a pressure pad is provided at a position, which is on an inner side of the pressure belt 13 and corresponds to an entry side of a nip region between the heating roller 11 and the pressure belt 13. The pressure pad is, for example, made of a silicon rubber, and is brought into pressure contact with the heating roller 11 at a preset pressure of 400 N, for instance. The pressure pad forms the nip together with the pressure roller 14.

The pressure roller 14 is made of, for example, a solid stainless material, and is formed to have an outer diameter of 20 mm. The pressure roller 14 is arranged on an exit side of the nip region between the heating roller 11 and the pressure belt 13, and is brought into pressure contact with the heating roller 11 to elastically deform the elastic layer by a proper amount of deformation. In this embodiment, the pressure roller 14 is rotationally driven by rotation transmitted from a rotation power source (not shown), the pressure belt 13 is circulated, and the tension roller 15 is slave-driven using a frictional force between the tension roller 15 and the pressure belt 13.

Further, the tension roller 15 that performs both the tensile force application function and the belt steering function is formed as a hollow roller, which is made of a stainless material and has an outer diameter of about 20 mm and an inner diameter of about 18 mm.

Next, a description will be provided of a changing unit, which is an essential part of a structure in which the conveyor-belt apparatus is used for the fixing device 114 in the first embodiment, and which changes the tension of the pressure belt 13, and a moving unit which is constructed as a belt steering mechanism for preventing the lateral movement from occurring.

—Changing Unit—

Figure 2:
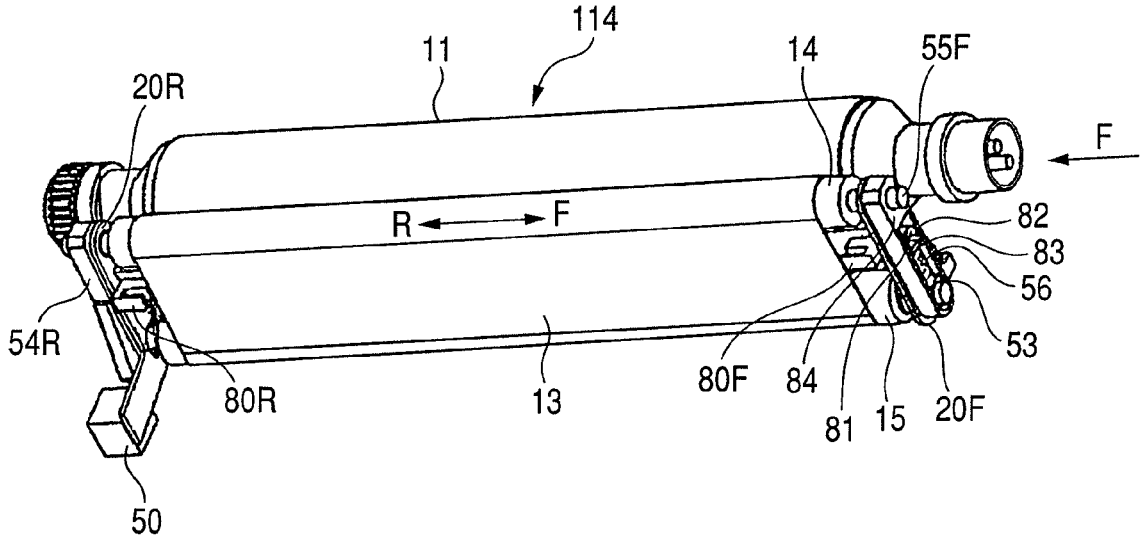
FIG. 2 illustrates as the first embodiment the conveyor-belt apparatus in the fixing device.
Figure 3:
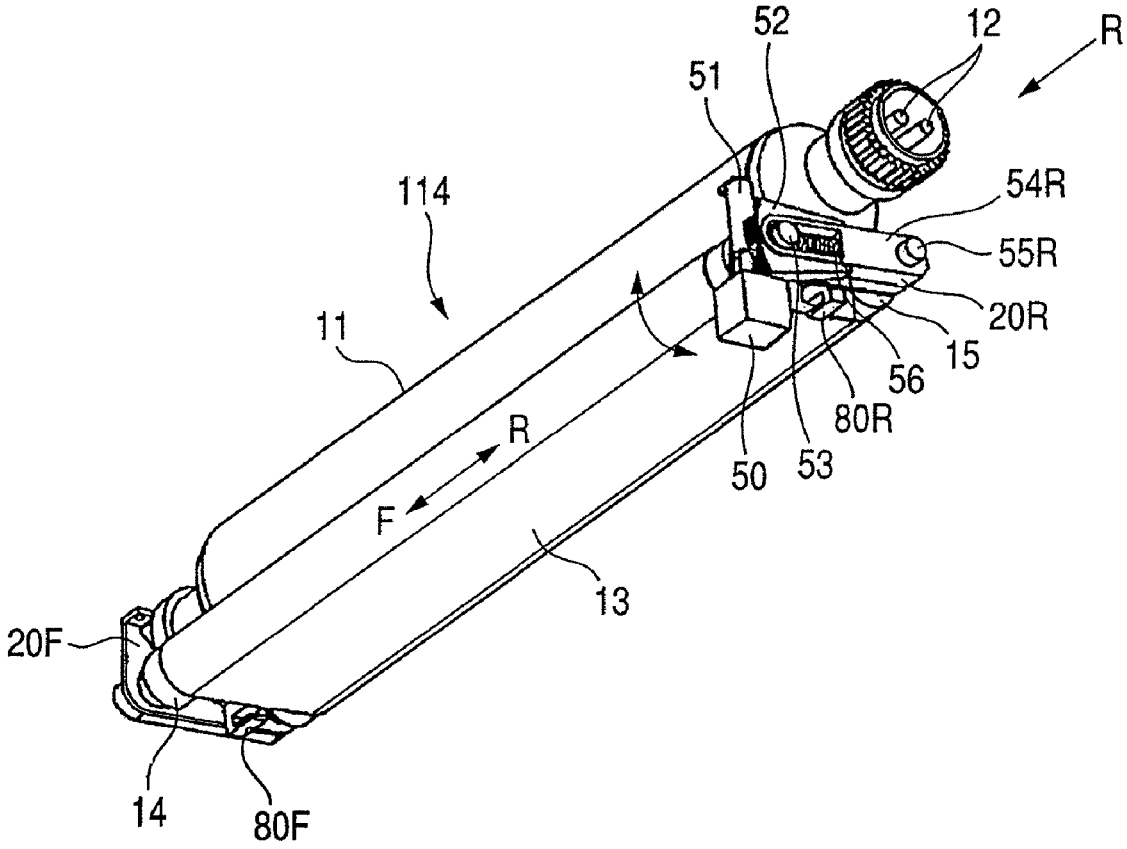
FIG. 3 illustrates a diagram viewed from a rear side of the conveyor-belt apparatus in the first embodiment.

As illustrated in FIG. 2 and FIG. 3, a tension roller supporting arm 54R is provided using a fixed shaft 55R provided on an outer side of a side plate 20R as a center of the rotational movement. One end of a rotating shaft of the tension roller 15 is slidably supported by the tension roller supporting arm 54R, and is rotatably and pivotally supported by a tension roller bearing 53. The sliding direction of the tension roller 15 is a direction for changing a center distance with respect to a rotating shaft of the pressure roller 14. In that case, the tension roller 15 is urged via the tension roller bearing 53 by a spring force of a tension spring 56 (urging member) toward a direction so that the belt tension is increased, namely, a direction for extending the center distance between the pressure roller 14 and the tension roller 15.

Besides, a tension roller supporting arm 84 is provided using a fixed shaft 55F provided on an outer side of a side plate 20F on the other side as a rotation center. The other end of the rotating shaft of the tension roller 15 is slidably supported by the tension roller supporting arm 84, and is also rotatably and pivotally supported by the tension roller bearing 53. The sliding direction in the other end side is as described above, and the pressing and urging structure by the tension spring 56 is also the same.

Figure 4:
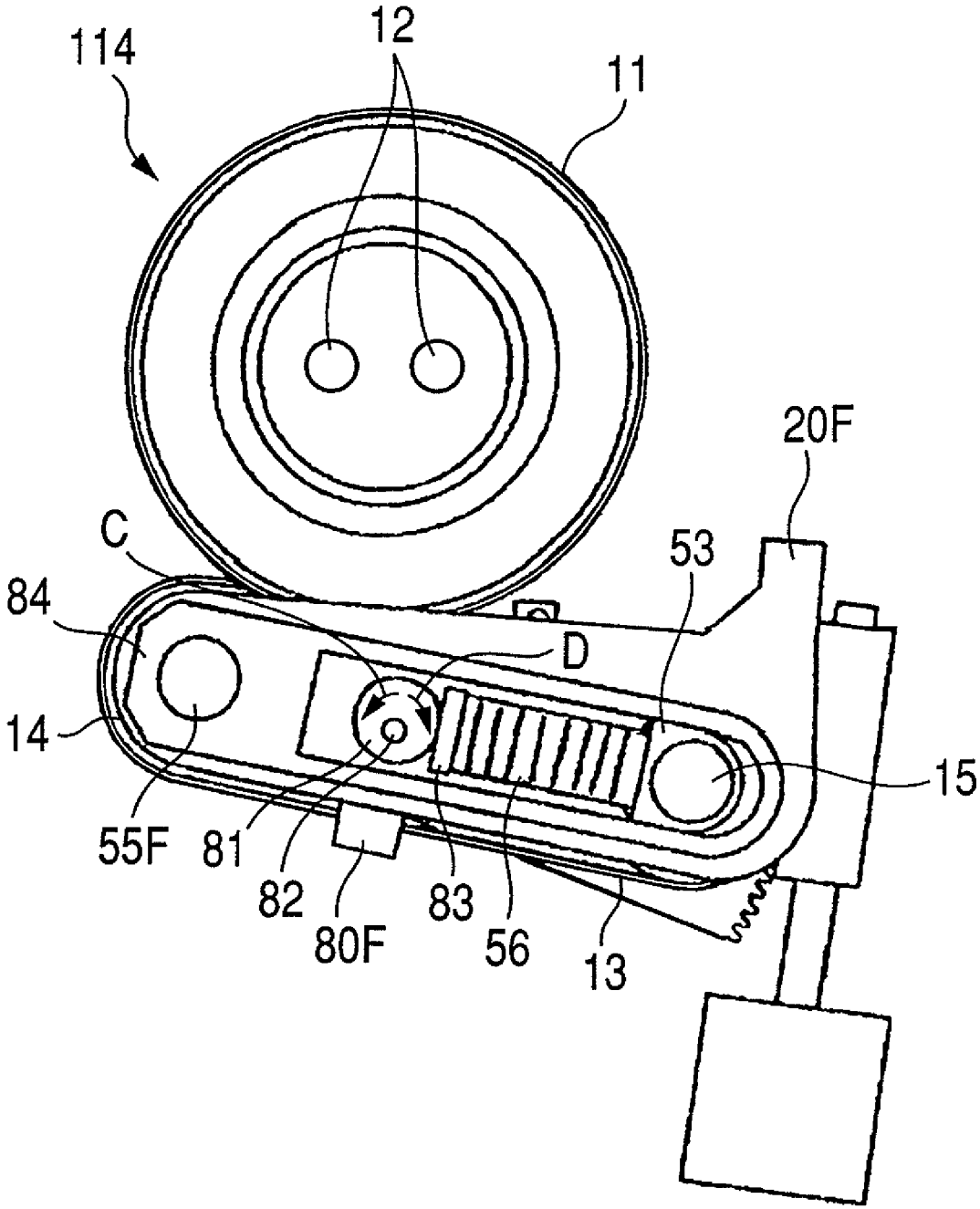
FIG. 4 illustrates a diagram viewed from a symbol F side of FIG. 2 in the first embodiment.

FIG. 4 illustrates a cam mechanism, which compresses and decompresses the tension spring 56. A cam 81 as the tension changing unit is pivotally supported by the tension roller supporting arm 84 using a cam shaft 82 as a center of the rotational movement, and rotates in directions indicated by the arrows C and D in FIG. 4 by receiving a rotational force from a cam rotation driving source (not shown). The cam 81 abuts against the tension spring 56 via a spring seat plate 83, and eccentrically rotates in the directions indicated by the arrows C and D to cause a phase angle change. As a result, an abutting force thereof is varied to change the tension of the pressure belt 13.

As described above, in a case where a moving unit described next is a supporting member, the changing unit described above moves the tension roller 15 toward a direction, which is substantially orthogonal to a displacement direction in which the rotating shaft of the tension roller 15 is displaced. With this operation, the tension to be imparted to the pressure belt 13 is changed.

—Moving Unit—

Figure 5:
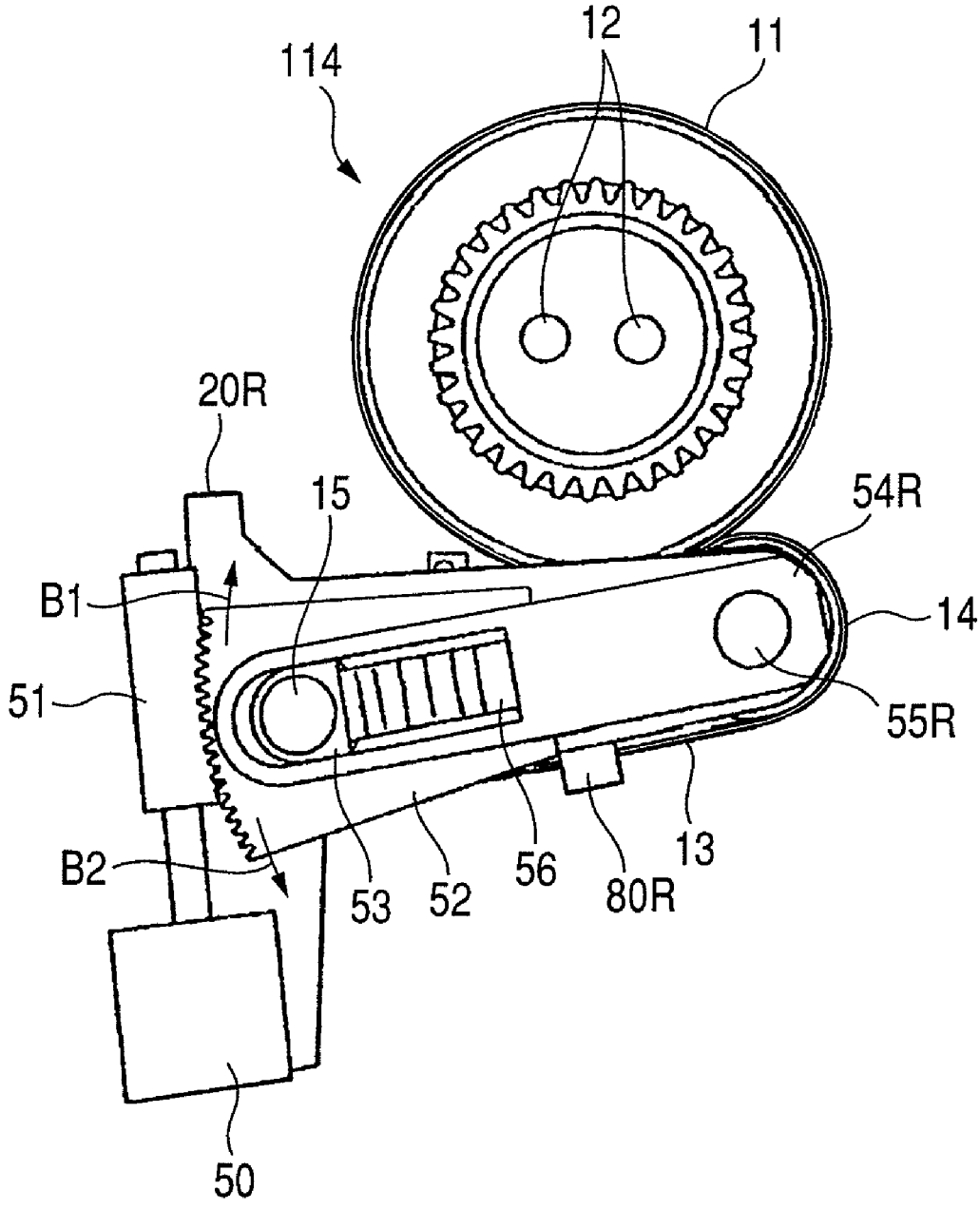
FIG. 5 illustrates a belt steering mechanism in the first embodiment.

Next, by referring to FIG. 5 and using FIG. 2 to FIG. 4 in combination, the belt steering mechanism as a moving unit will be described. The tension roller supporting arm 54R retained by the side plate 20R rotates about the fixed shaft 55R as a rotation center, and a tension roller supporting arm retained by the side plate 20F on the other side also rotates about the fixed shaft 55F as a rotation center. A gear 52, which functions like a pinion, is rotatably and pivotally supported by the tension roller supporting arm 54R using the fixed shaft 55R as a swing center, and is mating with a worm gear 51 which rotates through a rotation power of a stepping motor (rotation power source) 50. Through the rotation of the worm gear 51, the gear 52 is swung in directions indicated by the arrows B1 and B2 in FIG. 5. In association with the swinging of the gear, the tension roller 15, being a supporting member, moves one end or the other end thereof in the longitudinal direction of the rotating shaft, in the directions indicated by the arrows B1 and B2. Owing to such movements of the rotating shaft of the tension roller 15, when the pressure belt 13 during a circulation moves laterally in a belt width direction, the steering function is accomplished such that the one end side of the belt width direction moves vertically.

On the other hand, in the belt width direction orthogonal to the circulation direction of the pressure belt 13, belt sensors (belt detection unit) 80F and 80R for detecting belt end positions of the pressure belt 13 are mounted to positions facing both ends of the pressure belt 13, respectively. Those belt sensors 80F and 80R each detect lateral positions F and R at both ends in the width direction of the pressure belt 13 and limitation positions Fe and Re indicating limitations when the pressure belt 13 moves laterally toward sides indicated by the arrows F and R. The limitation position Fe is located in the arrow F direction with respect to the lateral position F. Similarly, the limitation position Re is located in an arrow R direction with respect to the lateral position R.

Specifically, in FIG. 2 and FIG. 3, when the pressure belt 13 performs, during the circulation, lateral movement toward the arrow F side which is one side of the belt width direction, the belt sensor 80F detects the lateral position F due to the belt behavior, and sends a detection signal to a control device.

The control device refers to a device which integrally governs control of an overall system including an image forming process in the printer main body 100 of FIG. 1, and includes a central processing unit (CPU) and a memory for recording and storing various information or signals and for reading out the information or the signals.

Figure 18:
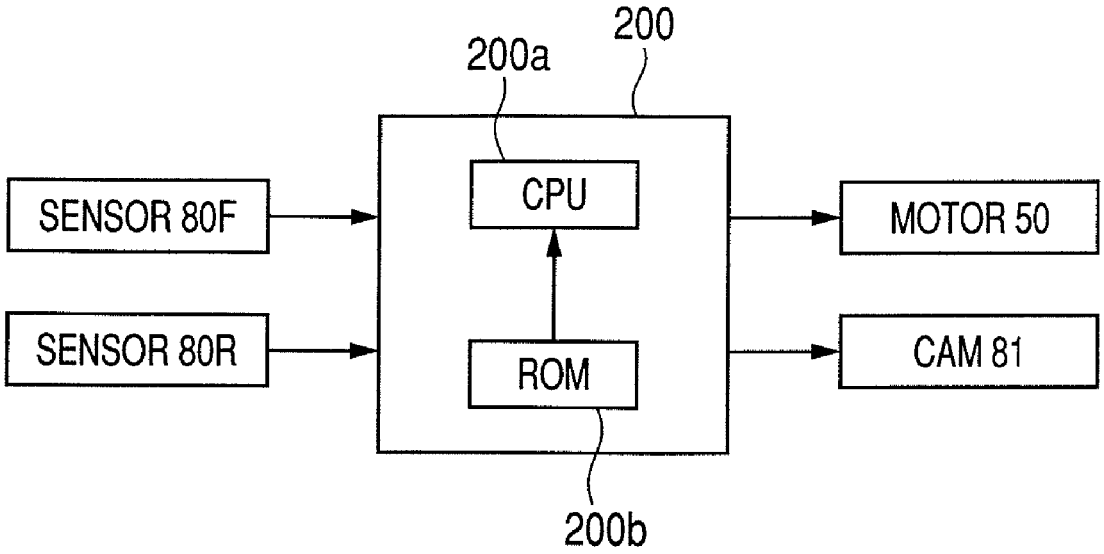
FIG. 18 is a block diagram illustrating a control circuit for controlling the first embodiment.

Such a control device described above conducts arithmetic processing upon receipt of the detection signal from the belt sensor 80F, and conducts a control operation described later in the order of each step in an operation flow chart illustrated in FIG. 6. The outline is as follows. Besides, FIG. 18 is a block diagram of a circuit for executing the flow chart illustrated in FIG. 6. In FIG. 18, a control device 200 includes a CPU 200*a* and a ROM 200*b* for containing a control program. The control device 200 controls operations of the stepping motor 50 and the cam 81 based on the detection signal from the belt sensor 80F and 80R.

The control device 200 transmits an operation signal as a result of the arithmetic processing to the stepping motor 50 as the rotation power source. The stepping motor 50 is activated into the switched-ON state to conduct a clockwise (CW) rotation, and outputs the rotation to rotate the gear 52 like a fan-shaped pinion about the shaft of the gear 52 in a steering direction indicated by an arrow B2 in FIG. 5. With this steering operation control, the tension roller 15 moves in the direction indicated by the arrow B2, and the pressure belt 13 returns toward the side indicated by the arrow R.

With respect to the pressure belt 13 returned toward the side indicated by the arrow R, the belt sensor 80R then detects that the belt end of the returned pressure belt 13 is returned to the lateral position R, and the belt sensor 80R transmits the detection signal to the control device 200. Then, the control device 200 causes the stepping motor 50 to conduct counter-clockwise (CCW) rotation so as to move the fan-shaped gear 52 about its shaft as a center in a steering direction indicated by an arrow B1. With this movement, the tension roller 15 moves in the direction indicated by the arrow B1, and the pressure belt 13 moves laterally toward the side indicated by the arrow F.

Such a belt control described above allows the pressure belt 13 to repeatedly alternately move toward the sides indicated by the arrows F and R, with the result that the pressure belt 13 continues the serpentine movement of alternate lateral movement having a constant regularity. At that time, the fan-shaped gear 52 rotates about its shaft as a center, and with this operation, the tension to be imparted to the pressure belt 13 is kept in constant by the tension spring 56.

FIG. 7 to FIG. 10 are time charts that each illustrate a correlation between the belt behavior of the pressure belt 13 due to use with time and detection signals obtained by belt sensors 80F and 80R.

Along with gradual lowering of the durability of the pressure belt 13 due to use with time, due to a difference between nip pressures in the longitudinal direction, fluctuation of tolerance in the longitudinal direction of the pressure pad arranged in the inner surface of the pressure belt 13, or the like, a balance of μ (friction factor) in the inner surface of the pressure belt 13 in the longitudinal direction is disrupted. As a result, the time period of the lateral movement of the pressure belt 13 becomes not equal intervals, and signals from the sensors 80F and 80R lose regularity, thereby being not available for an ON operation for the same period of time.

Figure 9:
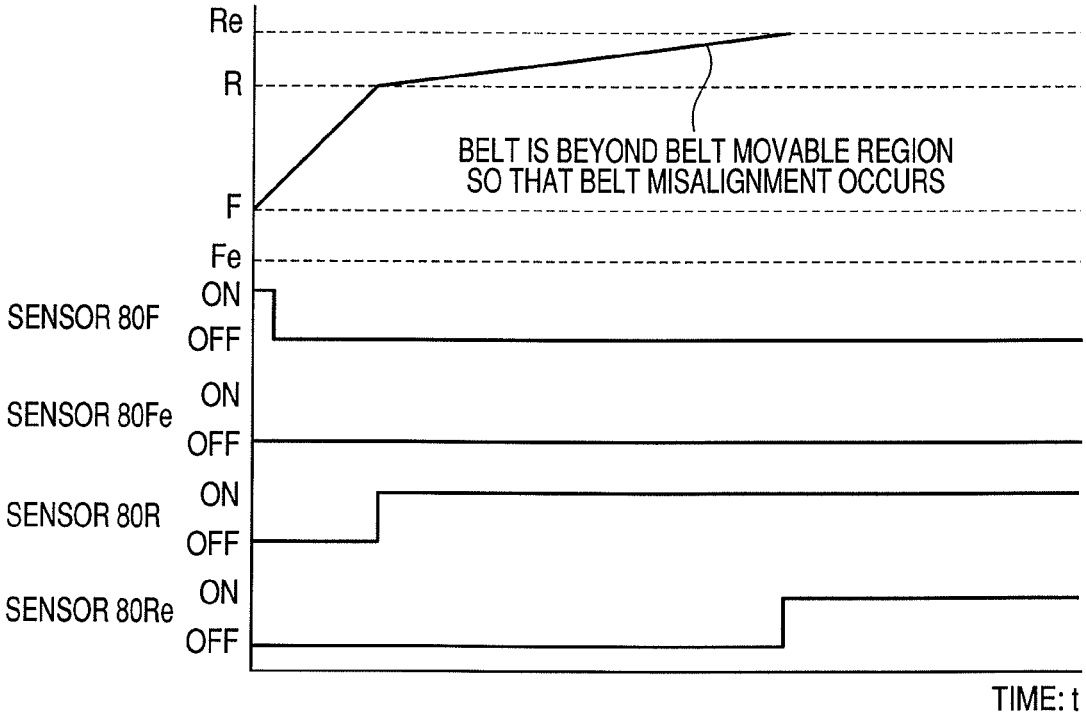
FIG. 9 illustrates the correlation between the belt behavior and the detection time of the sensor in the first embodiment.
Figure 10:
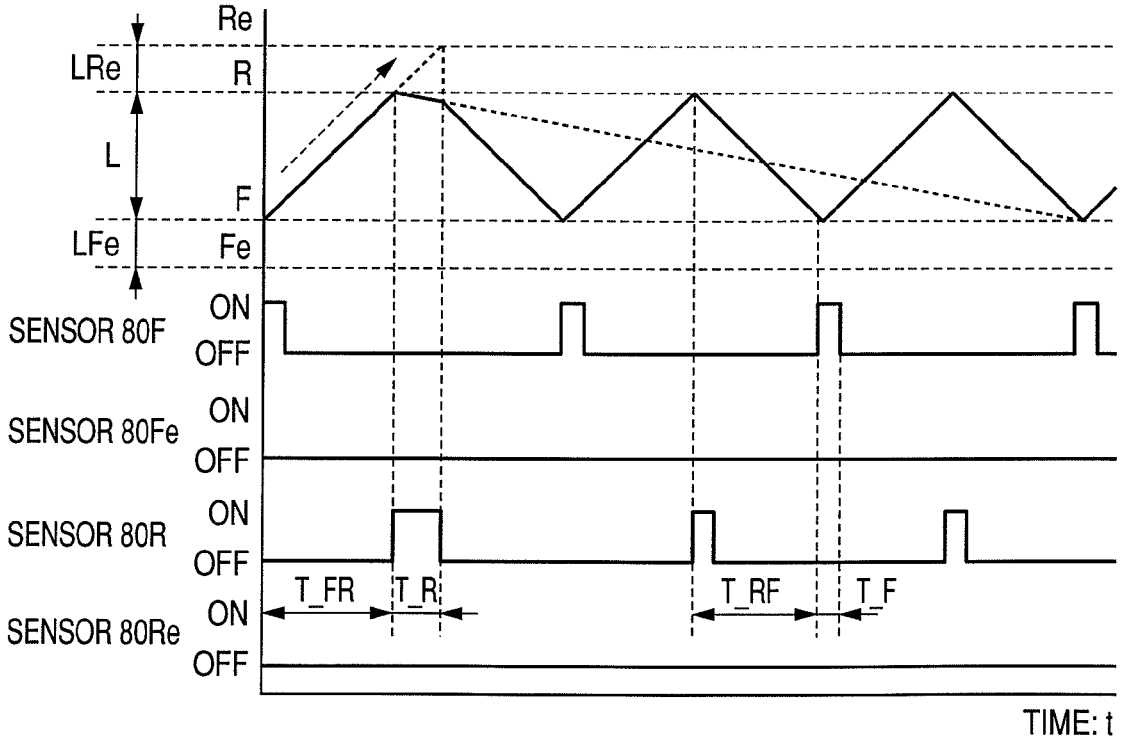
FIG. 10 illustrates the correlation between the belt behavior and the detection time of the sensor in the first embodiment.
Figure 11:
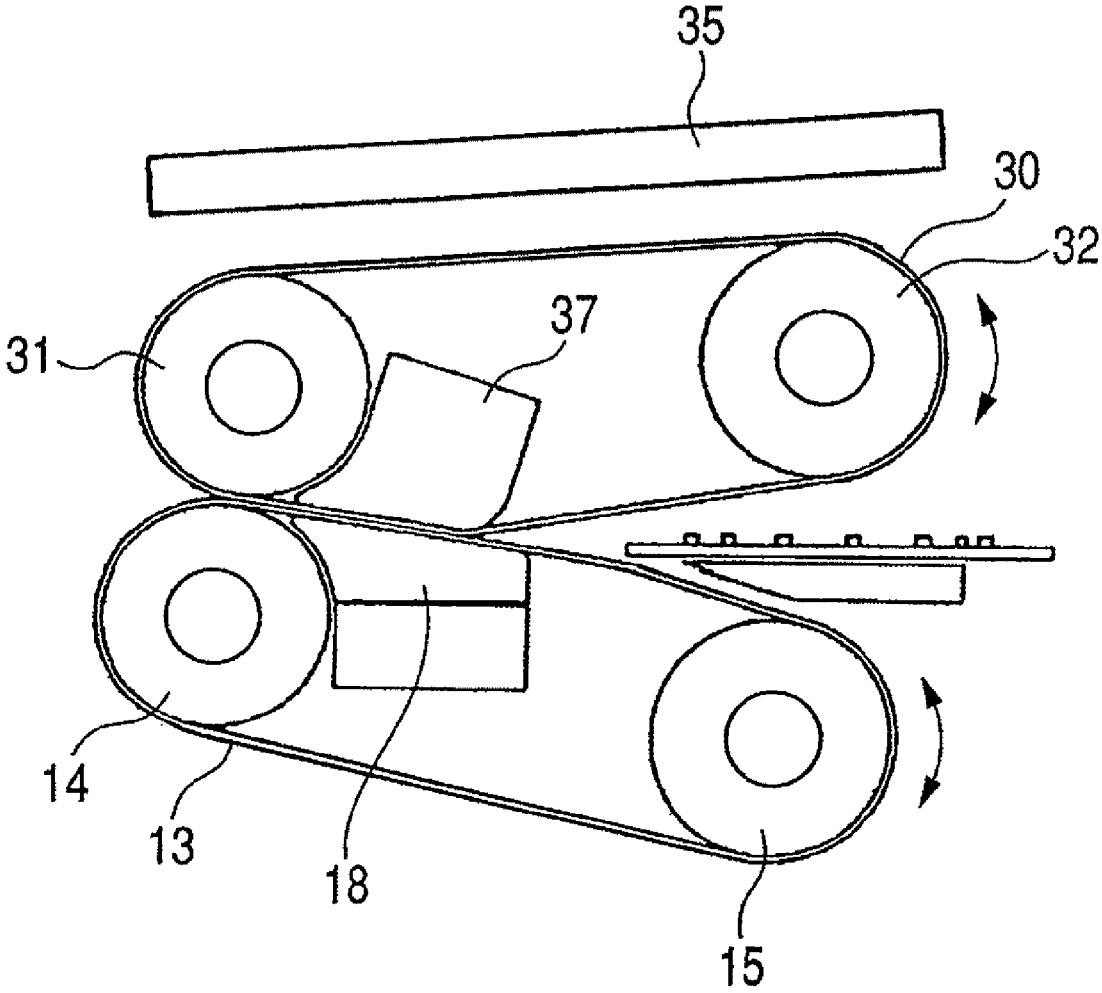
FIG. 11 illustrates a conveyor-belt apparatus in a fixing device according to a second embodiment.

If the use of the pressure belt 13 is continued as it is, as illustrated in FIG. 9, the pressure belt 13 transcends a preset movement range, resulting in finally causing the belt misalignment.

Figure 8:
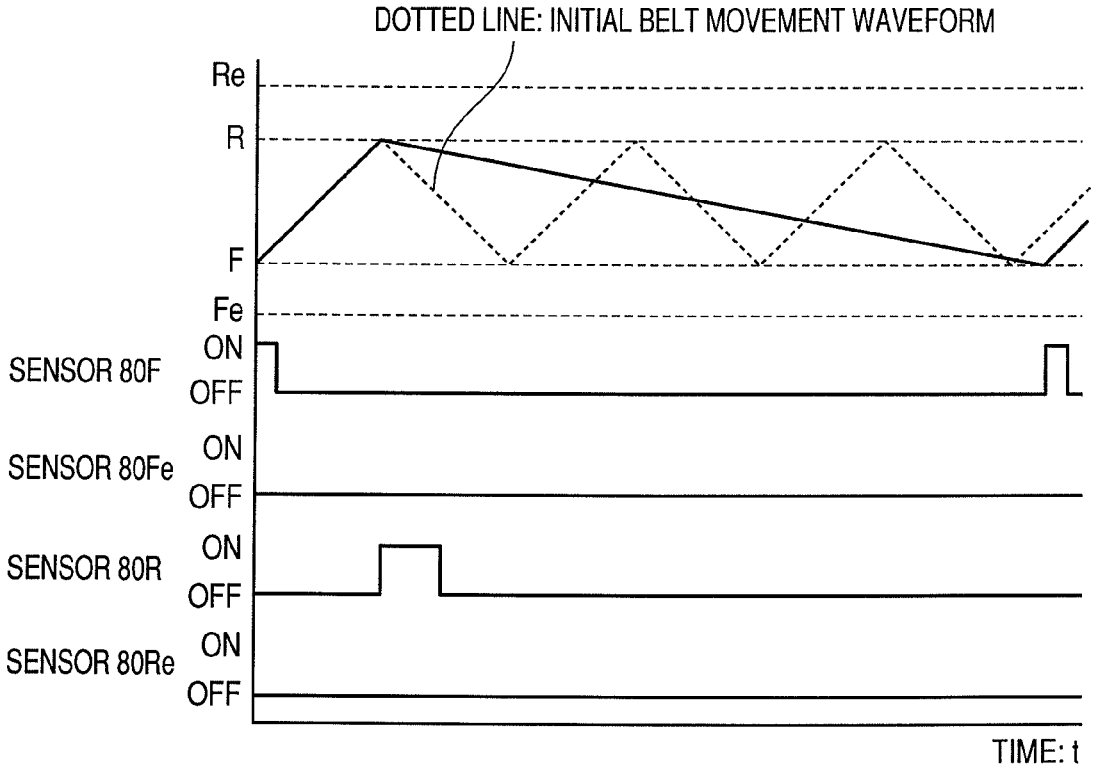
FIG. 8 illustrates the correlation between the belt behavior and the detection time of the sensor in the first embodiment.

In the state as illustrated in FIG. 8, the friction factor (μ) of the inner surface of the pressure belt 13 on the F side in the longitudinal direction increases, resulting in difficult for the pressure belt 13 to move from the R side to the F side.

Hereinafter, the above-mentioned operations will be described in order with reference to a flow chart of FIG. 6.

If the sensor 80F detects that the pressure belt 13 arrives at the lateral position F (S101), the control device 200 allows the stepping motor 50 to perform the CW rotation (S102), to thereby move the tension roller 15 in the direction indicated by the arrow B2 (S103). With this, operation of returning the pressure belt 13 toward the side indicated by the arrow R is carried out.

The control device 200 calculates a time at which the pressure belt 13 arrives at a limitation position Fe, which is a limitation position to which the pressure belt 13 may move, based on a speed of the lateral movement of the pressure belt 13, and judges whether or not allowing the cam 81 to operate from the arithmetic results (S104). Specifically, the control device 200 judges, based on information relating to the speed of the movement in the pressure belt 13 width direction, whether the pressure belt 13 is operable or not in a "mode", as "an executing unit", for displacing "the tension roller 15 as the supporting member" by the above-mentioned "moving unit".

Figure 6:
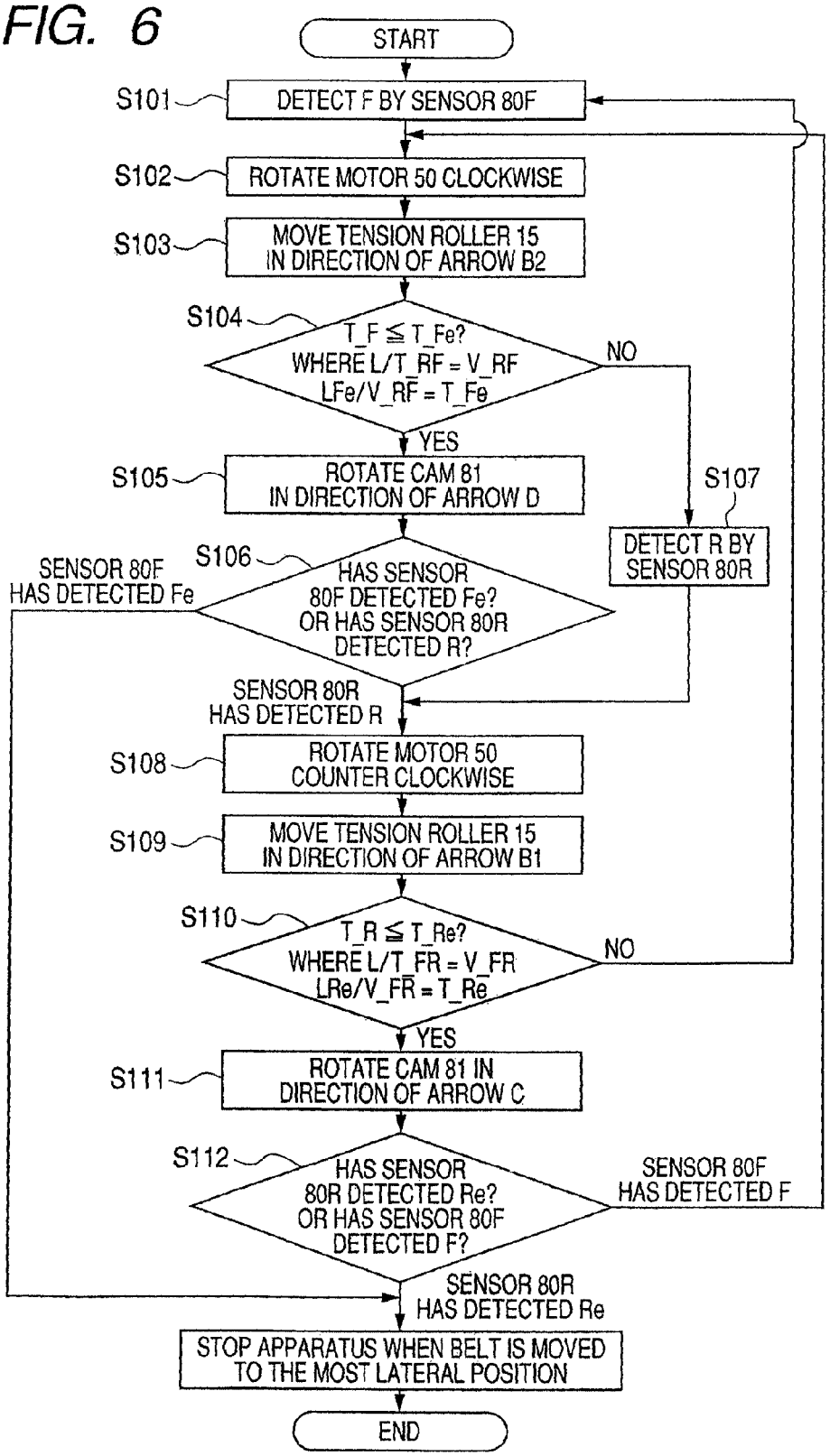
FIG. 6 is a flowchart illustrating a sequence of steps in a control operation for determining a cam operation in the first embodiment.
Figure 7:
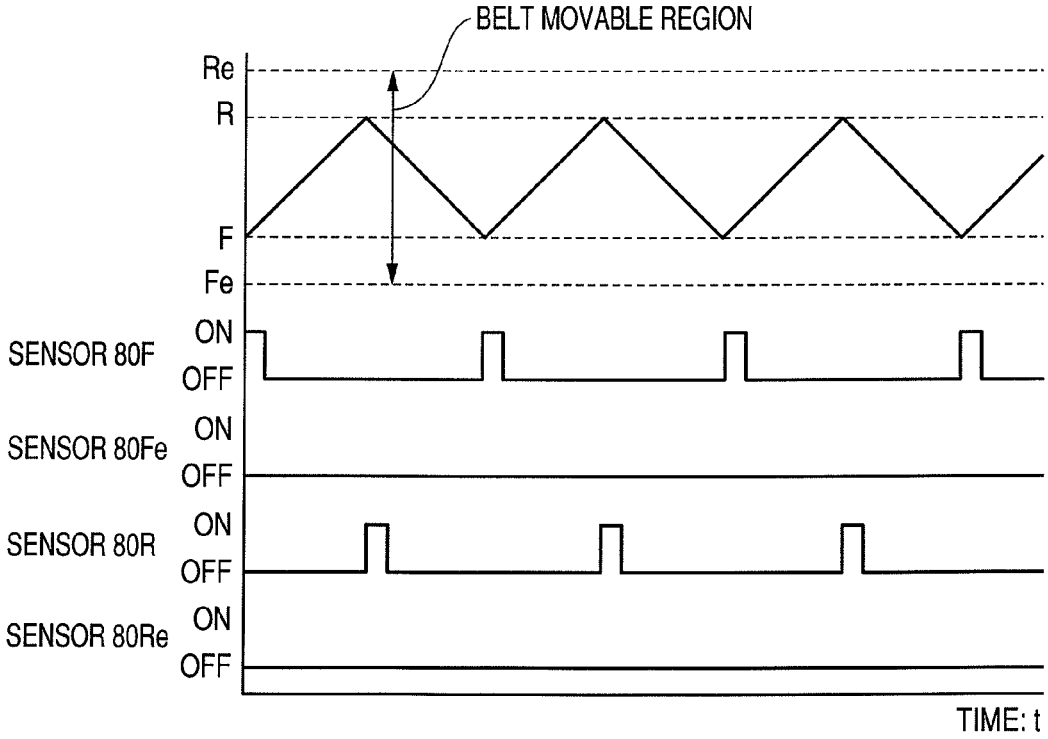
FIG. 7 illustrates a correlation between a belt behavior and a detection time of a sensor in the first embodiment.

Then, at step S104 in FIG. 6, a reference symbol "L" represents a moving distance of the pressure belt 13, which is a distance between the lateral position F and the lateral position R. Reference symbol "T_RF" represents a period of time required for the pressure belt 13 to move from the lateral position R to the lateral position F. Reference symbol "V_RF (=L/T_RF)" represents a speed of the pressure belt 13 when the pressure belt 13 moves from the lateral position R to the lateral position F. Reference symbol "LFe" represents a distance from the lateral position F to the limitation position Fe. Reference symbol "T_F(=LFe/V_RF)" represents a time period required for the pressure belt 13 to move from the lateral position F to the limitation position Fe at the speed "V_RF". Reference symbol "T_Fe" represents an actual ON time of the sensor 80R.

The control device 200 uses parameters as represented by the above-mentioned reference symbols, and from the following relational expression (1):

$$T_F \leqq T_Fe \tag{1}$$

the control device 200 decides whether the cam 81 should be operated or not.

If "T_F≦T_Fe" is established (S104, YES), the control device 200 rotates the cam 81 in the direction indicated by the arrow D in FIG. 4. After the rotation of the cam 81 in the direction indicated by the arrow D, if the sensor 80R detects that the pressure belt 13 arrives at the lateral position R (S106, sensor 80R detects ON), the control device 200 allows the stepping motor 50 to perform the CCW rotation (S108), to thereby move the tension roller 15 in the direction indicated by the arrow B1 (S109). As a result, the operation to return the pressure belt 13 toward the side indicated by the arrow F is carried out.

In the step S104, if "T_F≦T_Fe" is not satisfied (S104, NO), the pressure belt 13 moves to the lateral position R, and the sensor 80R detects that the pressure belt 13 arrives at the lateral position R (S107). Then, the control device 200 allows the stepping motor 50 to perform the CCW rotation (S108), to thereby move the tension roller 15 in the direction indicated by the arrow B1 (S109).

Similar to the step S104, in a step S110, Reference symbol L represents a distance between the lateral position F and the lateral position R, and represents the moving distance of the pressure belt 13. Reference symbol "T_FR" represents a time period required for the pressure belt 13 to move between the lateral position F and the lateral position R. Reference symbol "V_FR(=L/T_FR)" represents a speed of the pressure belt 13 between the lateral position F and the lateral position R.

Reference symbol "LRe" represents a distance between the lateral position R and the limitation position Re. Reference symbol "T_R(=LRe/V_FR)" represents a time period required for the pressure belt 13 to move from the lateral position R to the limitation position Re at the speed "V_FR". Reference symbol "T_Re" represents an actual ON time of the sensor 80R.

The control device 200 uses parameters as represented by the above-mentioned respective reference symbols, and from the following relational expression (2):

$$T_R \leqq T_Re \quad (2)$$

the control device 200 decides whether the cam 81 should be operated or not.

The state illustrated in FIG. 8 satisfies "T_R≦T_Re" in the relational expression (2). Specifically, in the worst case, it is conceivable that the pressure belt 13 advances as it is in the manner as shown by the dotted line arrow at the same speed as the speed "V_FR" from F to R, and reaches the limitation position Re which is a limitation of movement. Accordingly, at this time, the cam 81 is allowed to rotate in the direction indicated by the arrow C by a predetermined amount (S111), and the tension of the pressure belt 13 is loosened on the F side, thereby lowering the frictional factor on the F side to recover the amplitude (or range) of reciprocating motion of the pressure belt 13 into the state illustrated in FIG. 10.

FIG. 8 illustrates a case where the movement of the pressure belt 13 from the R side to the F side is slowed. On the contrary, in the case where the movement of the pressure belt 13 from the F side to the R side is slowed, the frictional factor of the inner surface of the pressure belt 13 on the R side in the longitudinal direction increases. As a result, the pressure belt 13 becomes hard to move from the F side to the R side.

Then, the cam 81 is allowed to rotate in the direction indicated by the arrow D by a predetermined amount (S105), and the tension of the pressure belt 13 is increased on the F side. With this, the frictional force on the R side is lowered to recover the amplitude (or range) of reciprocating motion of the pressure belt 13 into the state illustrated in FIG. 10. A method of judging the rotation of the cam 81 is the same as that of the belt movement from F side to the R side.

If the cam 81 is rotated in the direction indicated by the arrow C (S111), and the sensor 80F detects that the pressure belt 13 arrives at the lateral position F (S112, sensor 80F detects F), the control device 200 allows the stepping motor 50 to perform the CW rotation (S102). In step S110, if "T_R≦T_Re" is not satisfied (S110, NO), the pressure belt 13 moves to the lateral position F, and the sensor 80F detects that the pressure belt 13 arrives at the lateral position F (S101).

Further, in step S105, if the cam 81 is allowed to rotate in the direction indicated by the arrow D, and the pressure belt 13 returns to the lateral position F, the sensor 80F detects that the pressure belt 13 arrives at the lateral position F (S112, sensor 80F detects F), and the control device 200 again allows the stepping motor 50 to perform the CW rotation (S102).

On the other hand, in step S105, though the cam 81 rotates in the direction indicated by the arrow D, if the pressure belt 13 arrives at the limitation position Fe, and the sensor 80F detects that the pressure belt 13 arrives at the limitation position Fe (S106, sensor 80F detects Fe), the control device 200 judges that it is impossible to conduct the lateral movement control of the pressure belt 13 with the rotation of the cam 81, and stops the image forming apparatus to stop the rotation of the pressure belt 13.

Similarly, though the cam 81 is rotated in the direction indicated by the arrow C (S111), if the pressure belt 13 arrives at the limitation position Re, and the sensor 80R detects that the pressure belt 13 arrives at the limitation position Re (S112, sensor 80R detects Re), the control device 200 functioning as the stopping unit stops the image forming apparatus to stop the rotation of the pressure belt 13.

Second Embodiment

Next, referring to FIG. 11 to FIG. 17, a description will be provided of a second embodiment of a case where a conveyor-belt apparatus according to this embodiment is applied to a fixing device 114 as a toner image heating apparatus of this embodiment.

Figure 12:
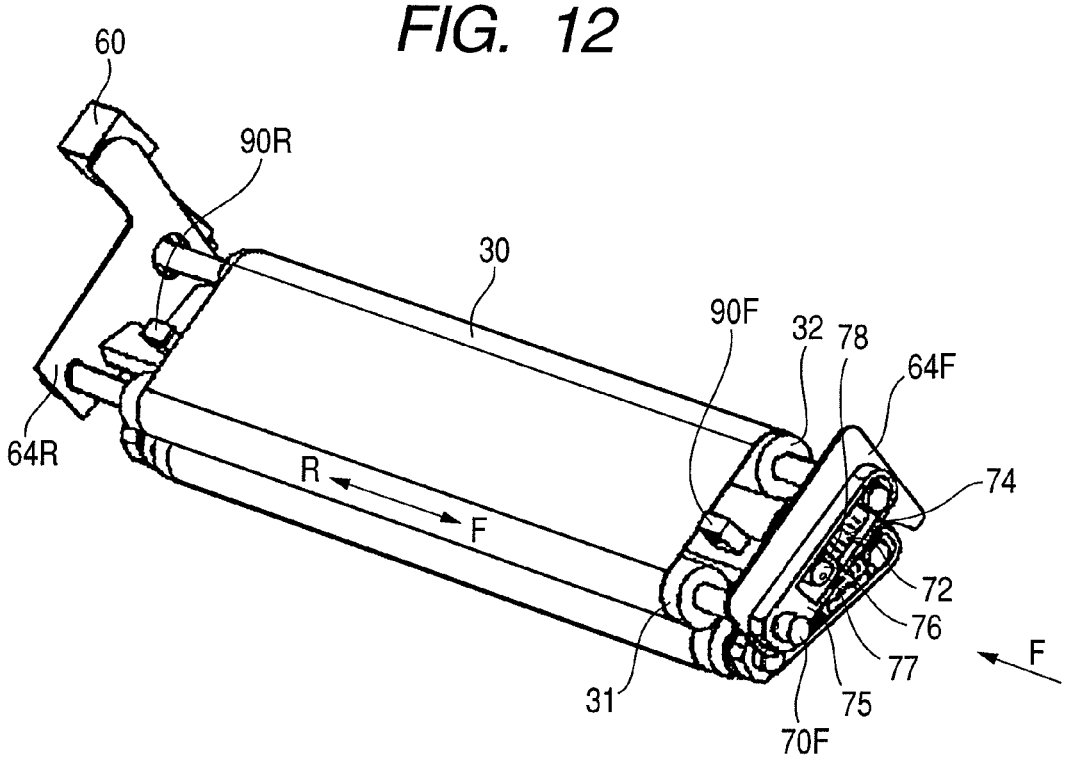
FIG. 12 illustrates the conveyor-belt apparatus in the fixing device according to the second embodiment.

In the second embodiment, instead of the heating roller (third rotation member) 11 according to the first embodiment, an endless heating belt 30 is provided as illustrated in FIG. 12. It is an aim to make the apparatus further compact, and to make the nip width wider with an employment of the heating belt 30. Then, in the second embodiment, belt sensors 90R and 90F each provided to both ends in the width direction of the heating belt 30, for which the lateral movement control is performed, may detect three positions (R1, R2, Re, F1, F2, and Fe) each provided in the width direction of the heating belt 30. With this structure, the lateral movement control may be simplified compared with the first embodiment.

In FIG. 12, the heating belt 30 is passed over two rollers including a drive roller (first rotary member) 31 and a tension roller (second rotary member) 32 so as to allow a circulation running at a preset tension of 120 N, for instance. The tension roller 32 has a function of imparting a tension to the heating belt 30 and also has a belt steering function for adjusting the serpentine movement of the heating belt 30 in the belt width direction. Such a tension roller 32 as described above is made of a stainless material and is formed as a hollow roller having an outer diameter of about 20 mm and an inner diameter of about 18 mm, for instance.

Further, a pad stay 37 is provided at a position, which is an entry side of a nip region between the heating belt 30 and the pressure belt 13 and inside the heating belt 30 upstream of the drive roller 31. The pad stay 37 is, for example, made of stainless steel (SUS material), and is brought into pressure contact with a pressure pad 18 at a preset pressure of 400 N, for instance. The pad stay 37 forms the nip together with the drive roller 31.

The drive roller 31 is made of, for example, a solid stainless material, and is formed by integrally forming a heat resistance silicon rubber elastic layer on a surface layer of a metal core which is formed to have an outer diameter of 18 mm. The drive roller 31 is arranged on an exit side of the nip region between the heating belt 30 and the pressure belt 13, and through the pressure contact of the pressure roller 14, the elastic layer is elastically deformed by a proper amount of deformation to cause distortion.

A material for the heating belt 30 of this embodiment may appropriately be selected as long as it is capable of being heated by an induction heating coil 35 and having heat resistance. For the heating belt 30, there may be used a nickel metal layer or a magnetic metal layer such as a stainless layer, which has a thickness of 75 μm, a width of 380 mm, a circumferential length of 200 mm, for instance, and is coated with a silicon rubber having a thickness of 300 μm.

Next, as an essential part of the fixing device according to the second embodiment, a description will be provided of a belt tension variable mechanism for adjusting the tensions of the pressure belt 13 and the heating belt 30 during circulation, and the belt steering mechanism for preventing the lateral movements of the pressure belt 13 from occurring during the circulation.

Figure 13:
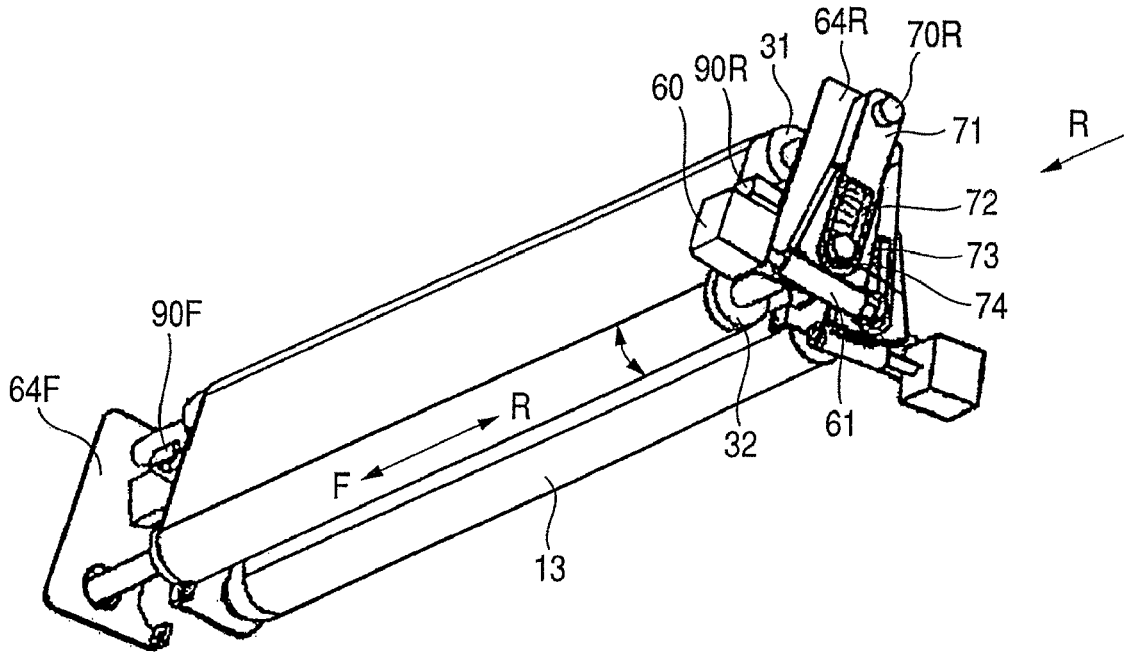
FIG. 13 illustrates the conveyor-belt apparatus in the fixing device according to the second embodiment.

In FIG. 13, a tension roller supporting arm 71 is pivotally supported about a fixed shaft 70R as a rotation center, which is provided to the outer side of a side plate 64R. The tension roller 32 is supported slidably in a belt tension imparting direction, and is rotatably and pivotally supported by a tension roller bearing 74. Besides, a tension spring 72 urges by pressing the tension roller 32 in the belt tension imparting direction through the tension roller bearing 74. Further, a gear 73 functioning as a pinion is fixed to the tension roller supporting arm 71, and mates with a worm gear 61 that rotates by receiving the rotation power from a stepping motor 60.

The belt sensors 90F and 90R for detecting the belt end positions are mounted at positions facing both ends of the heating belt 30 in the belt width direction. The belt sensors 90F and 90R are constructed to detect positions of the heating belt 30 in the longitudinal direction, and to detect the lateral positions F1 and R1 each being preset positions, the cam operation positions F2 and R2 each being starting points activating a cam 76 described latter, and the limitation positions Fe and Re being the limitation of the belt movement. The lateral position F1, the cam operation position F2, and the limitation position Fe are provided in this order toward the side indicated by the arrow F. Similarly, the lateral position R1, the cam operation position R2, and the limitation position Re are provided in this order toward the side indicated by the arrow R.

Further, a tension roller supporting arm 75 is pivotally supported about a fixed shaft 70F as a rotation center, which is provided on an outer side of a side plate 64F, which is illustrated on a right side of FIG. 12, and the tension roller 32 is rotatably and pivotally supported by a tension roller bearing 74 slidably in the belt tension imparting direction. Further, through intermediation of the tension roller bearing 74, the tension roller 32 is urged in the belt tension imparting direction by the tension spring 56. To the tension roller supporting arm 75, the cam 76 is rotatably supported about a cam shaft 77 as a rotation center, and receives a rotation force from a cam rotation driving source (not shown). The cam 76 as the tension changing unit abuts against the tension spring 72 via a spring seat plate 78, and changes the tension of the heating belt 30 on the basis of a phase angle in which the cam 76 rotates.

The tension roller supporting arm 71 on the side plate 64R side is rotatable about the fixed shaft 70R as a center, and the tension roller supporting arm 75 on the side plate 64F side is fixed and supported by the side plate 64F about the fixed shaft 70F as a center. With this structure, the tension roller 32 performs a predetermined steering function in directions indicated by the arrows A1 and A2 on the tension roller supporting arm 71 side about the tension roller supporting arm 75 as a center.

Figure 19:
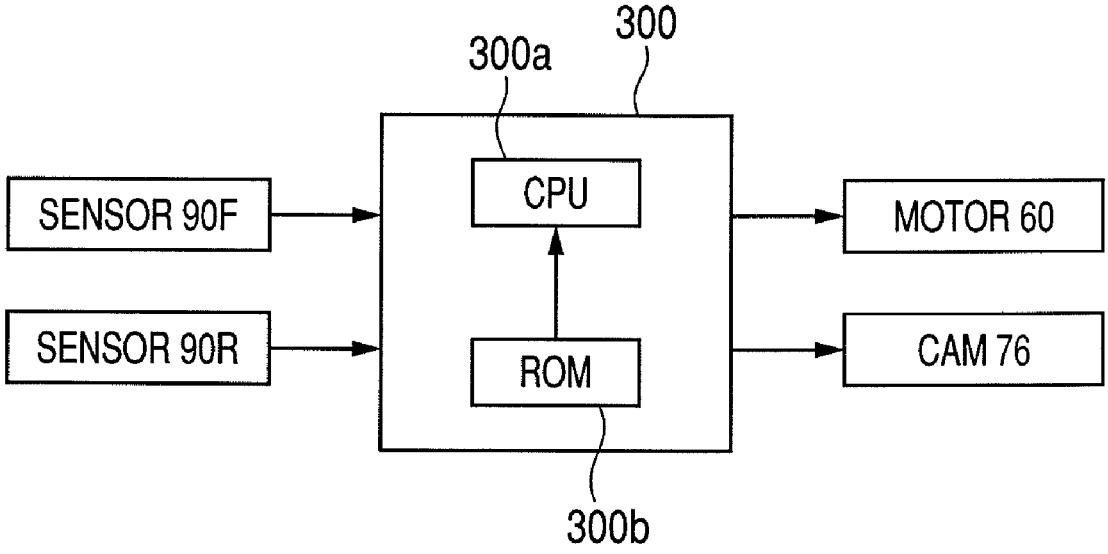
FIG. 19 is a block diagram illustrating a control circuit for controlling the second embodiment.

Then, as illustrated in FIG. 12 and FIG. 13, if the heating belt 30 moves toward and approaches the side indicated by the arrow R, and the belt sensor 90R detects the lateral position R of the heating belt 30 to transmit the detection signal to a control device 300 as illustrated in FIG. 19.

FIG. 19 is a block diagram of a circuit for controlling the lateral movement of the heating belt 30 according to this embodiment.

The control device 300 includes a CPU 300*a* and a ROM 300*b* containing a control program. The control device 300 controls operations of the stepping motor 60 and the cam 76 on the basis of the signals from the sensors 90R1 and 90F1.

Figure 14:
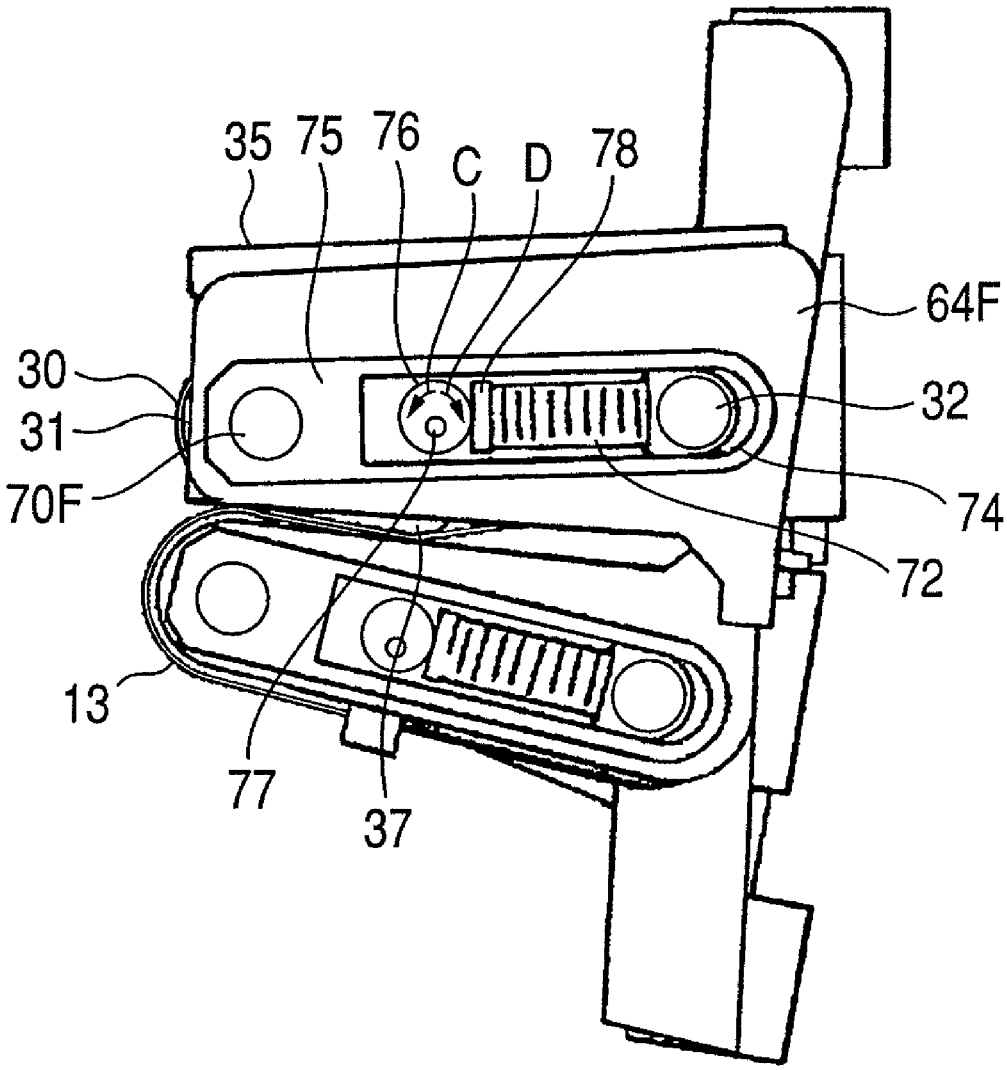
FIG. 14 illustrates a belt steering mechanism on the side indicated by the arrow F in FIG. 12 in the second embodiment.
Figure 15:
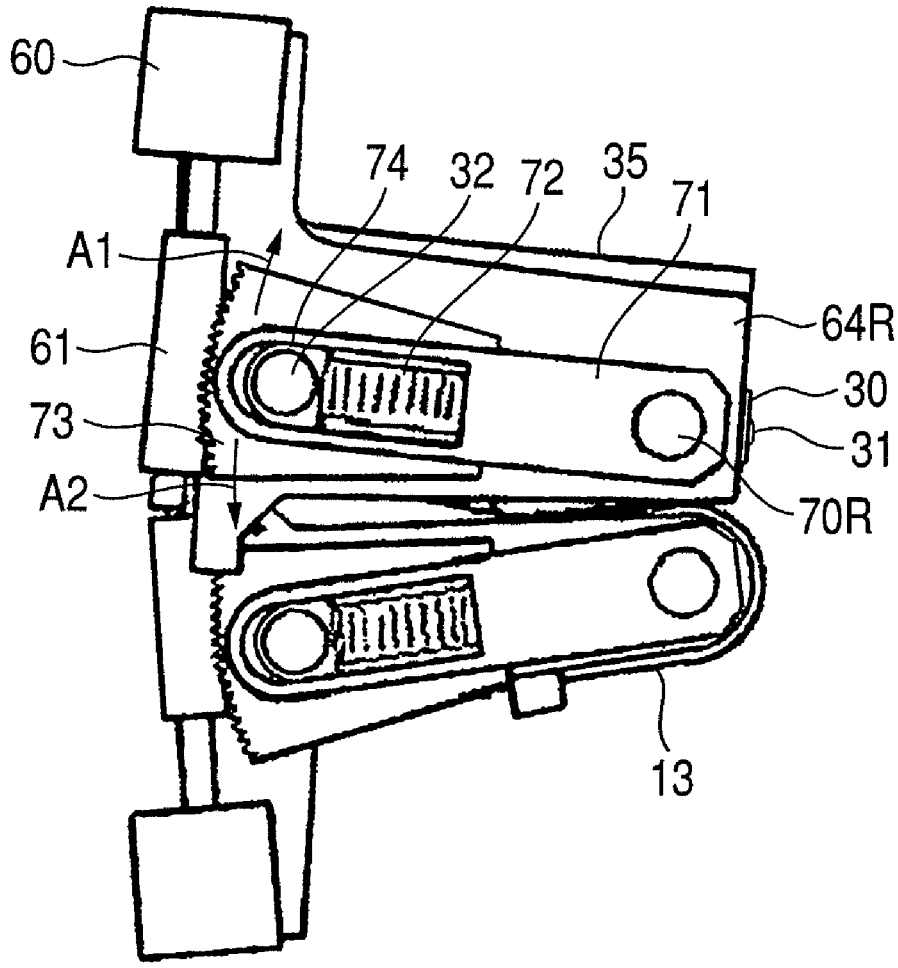
FIG. 15 illustrates a belt steering mechanism on the side indicated by the arrow R in FIG. 13 in the second embodiment.

The control device 300 rotates the stepping motor 60 so as to move the gear 73 upwardly about the fixed shaft 70R. As a result, the heating belt 30 laterally moves toward the side indicated by the arrow F of FIG. 12 and FIG. 13, which is a reverse direction, and the belt sensor 90F detects the lateral position F to transmit the detection signal to the control device 300. The control device 300 rotates the stepping motor 60 so as to move the gear 73 downwardly about the shaft 70R. Through the control of the repeated operations described above, the heating belt 30 continues a predetermined serpentine. FIG. 14 is a drawing viewing the side indicated by the arrow F in FIG. 12, and FIG. 15 is a drawing viewing the side indicated by the arrow R in FIG. 13. Hereinafter, a description will be provided in conjunction with FIG. 14 and FIG. 15.

The relation between the belt behavior, which occurs in such case that the durability of the heating belt 30 is lowered due to use with time, and the detection time by the belt sensors 90R, 90F is the same as that for the pressure belt 13 according to the first embodiment.

Further, as use of the heating belt 30 with time advances, the difference of the nip pressure in the longitudinal direction, fluctuation of tolerance in the longitudinal direction of the pad stay 37 arranged in the inner surface of the heating belt 30, or the like, and the balance of μ (friction factor) in the inner surface of the heating belt 30 in the longitudinal direction is disrupted. As a result, the duration of different instances of the lateral movement of the heating belt 30 becomes unequal, and signals from the sensors 90F and 90R lose regularity, thereby not being available for an ON operation for the same period of time. If the use of the heating belt 30 is continued as it is, as illustrated in FIG. 9, the heating belt 30 exceeds a preset movement range, resulting in finally causing the misalignment of the heating belt 30.

Figure 17:
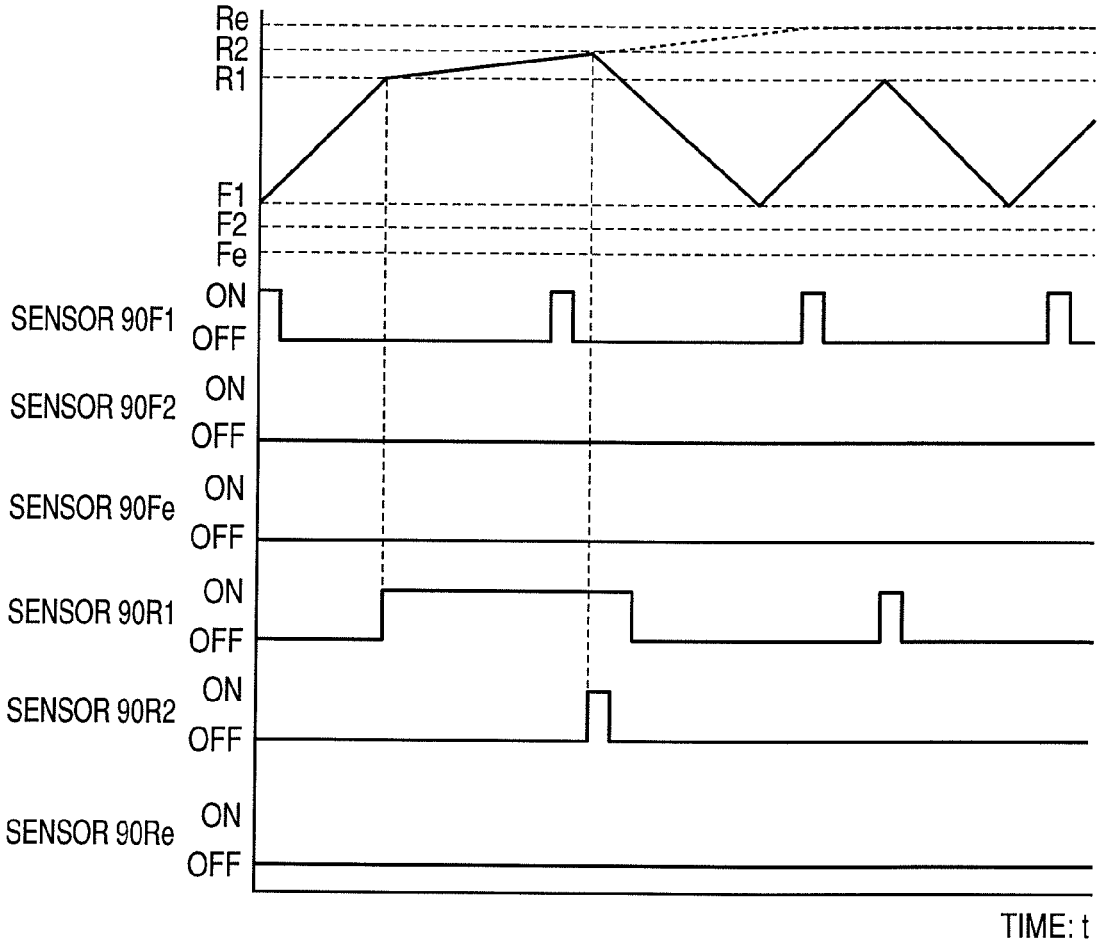
FIG. 17 is a graph illustrating a correlation between a belt behavior and a detection time of a sensor in the second embodiment.

FIG. 17 illustrates a state in which the friction factor (μ) on the F side in the longitudinal direction of an inner surface of the heating belt 30 increases, and the heating belt 30 becomes hard to move from the R side to the F side. If this state is kept as it is, the state illustrated in FIG. 9 is obtained.

Figure 16:
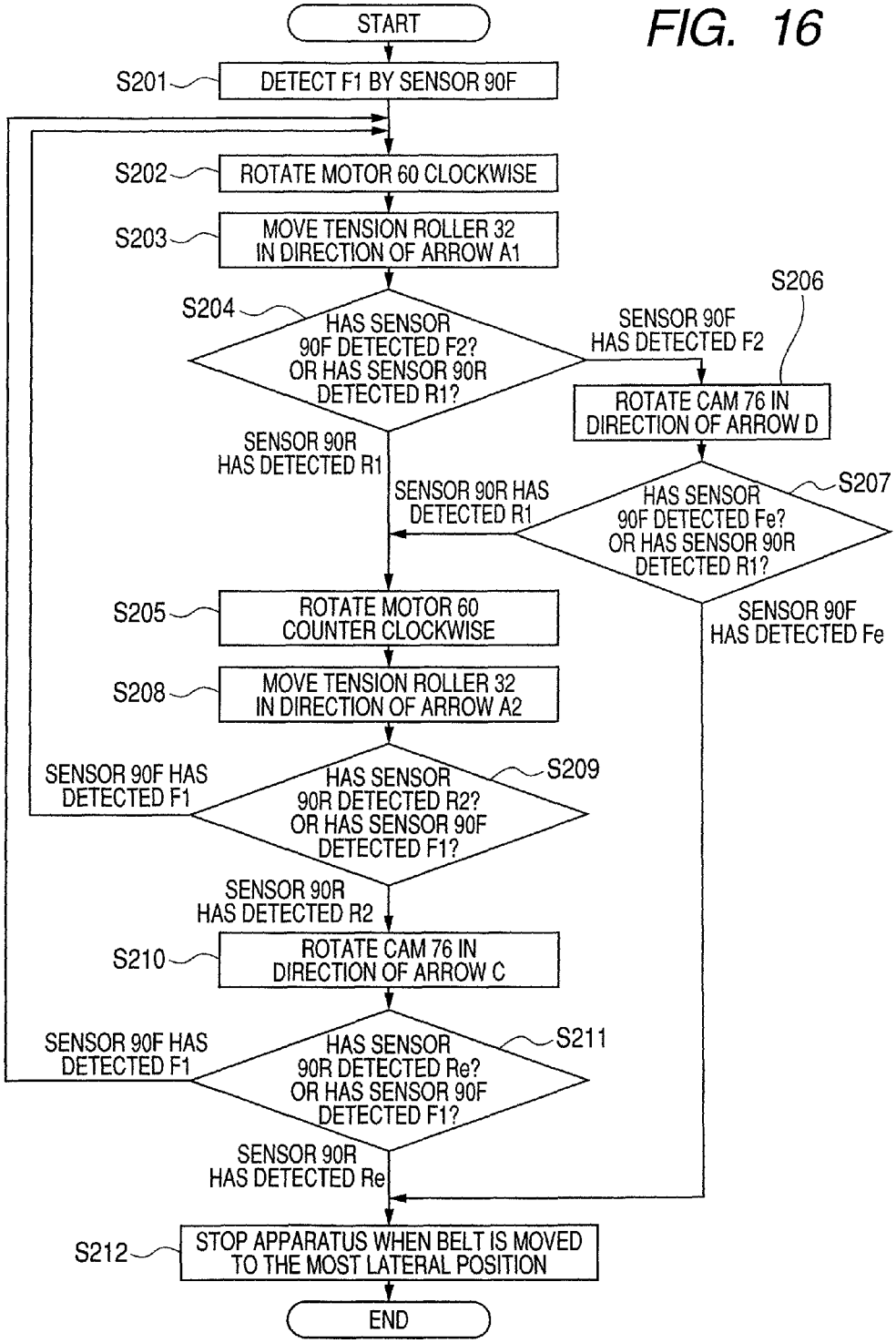
FIG. 16 is a flowchart illustrating a sequence of steps in a control operation for determining a cam operation in the second embodiment.

The control device 300 rotates, in accordance with a detection signal output from a belt sensor 90R2, a cam 76 in the direction indicated by the arrow C by a preset amount of rotation on the basis of an operation flow chart of FIG. 16, and loosens the tension of the heating belt 30 on the F side. With this, the friction factor on the F side is lowered, to thereby change the amplitude (or range) of reciprocating motion of the heating belt 30 to the state as illustrated on the right side of FIG. 17.

FIG. 17 illustrates a case where the movement of the heating belt 30 from R side to F side is slowed. In the case where the movement of the heating belt 30 reversely from F side to R side is slowed, the friction factor in the inner surface of the heating belt 30 on the R side in the longitudinal direction increases, resulting in difficulty in moving the heating belt 30 from the F side to the R side. In this case, if the state of the sensor 90F2 becomes ON, the cam 76 is allowed to rotate in the direction indicated by the arrow D by a preset amount of rotation on the basis of the operation flow chart of FIG. 16, and the tension of the heating belt 30 is increased on the F side. With this operation, the friction factor on the R side is lowered to recover the amplitude (or range) of reciprocating motion of the belt.

Referring to FIG. 16, a description will be provided of a flow of the lateral movement control of the heating belt 30 according to this embodiment. If the sensor 90F detects that the heating belt 30 arrives at the lateral position F1 (S201), the control device 300 allows a motor 60 to perform a clockwise (CW) rotation (S202), and moves the tension roller 32 in the direction indicated by the arrow A1 of FIG. 15 (S203). With this operation, the control device 300 operates so that the heating belt 30 is returned toward the side indicated by the arrow R of FIG. 12.

The control device 300 judges whether or not the cam 76 should be operated, on the basis of the movement direction of the heating belt 30 after movement of the tension roller 32 (S204). After the movement of the tension roller 32 (S203), if the sensor 90F detects that the heating belt 30 arrives at the cam operation position F2 (S204, sensor 90F detects F2), the control device 300 rotates the cam 76 in the direction indicated by the arrow D of FIG. 14 (S206). Subsequently, if the sensor 90R detects that the heating belt 30 arrives at the lateral position R1 (S207, sensor 90R detects R1), the control device 300 allows the motor 60 to perform counterclockwise rotation (CCW) (S205), and moves the tension roller 32 in the direction indicated by the arrow A2 of FIG. 15 (S208) to operate so that the heating belt 30 returns toward the side indicated by the arrow F of FIG. 12. Similarly, in step S204, if the sensor 90R detects that the heating belt 30 arrives at the lateral position R1 (S204, sensor 90R detects R1), the control device 300 allows the motor 60 to perform the CCW rotation (S205). Despite the movement of the tension roller 32 in step S208, if the sensor 90R detects that the heating belt 30 arrives at the cam operation position R2 (S209, sensor 90R detects R2), the control device 300 rotates the cam 76 in the direction indicated by the arrow C of FIG. 14 (S210), to thereby adjust the frictional force between the tension roller 32 and the heating belt 15. On the other hand, in step S209, if the sensor 90F detects that the heating belt 30 arrives at the lateral position F1, the motor 60 is allowed to perform the CW rotation (S202), and the operation of moving the heating belt 30 toward the R direction is carried out again.

The cam 76 was rotated in step S210, but if the heating belt 30 moves toward the side indicated by the arrow R and the sensor 90R detects that the heating belt 30 arrives at the limitation position Re (S211, sensor 90R detects Re), the control device 300 judges that the lateral movement control is unavailable, and stops the operation of the image forming apparatus to thereby stop the rotation of the heating belt 30 (S212). Similarly, in step S207, if the sensor 90F detects that the heating belt 30 arrives at the limitation position Fe, the control device 300 as the stopping unit stops the image forming apparatus to thereby stop the rotation of the heating belt 30 (S212).

As described above, several examples of embodiments of the present invention are described, but it is to be understood that the present invention is not limited thereto, and that other embodiments, application examples, modification examples, and a combination thereof are possible without departing from the technical idea of the present invention.

For example, in the above-mentioned respective embodiments, a description was provided of the case where the conveyor-belt apparatus is applied, as the fixing device of the image forming apparatus, to the toner image heating apparatus. However, the conveyor-belt apparatus may be applied to the pressure belt provided to the fixing device, or may be applied not only to the pressure belt, but also to a belt such as an intermediate transfer belt. Further, when the image bearing member is formed into a belt shape, the image bearing member may be applicable to the image bearing belt. In addition, the conveyor-belt apparatus may be applied not only to the image forming apparatus, but also to an image creating apparatus or a display device which requires high precision circulation of the endless belt. For example, the conveyor-belt apparatus may be applied to a film-shaped belt driving device of a display board in an electronic white board, a driving device of an original conveyor belt in a scanner, and the like.

In addition, in the respective embodiments, there is described a structure in which a cam is provided to one of the main components of the changing unit for changing the belt tension, but is not limited to the cam member, and a combination of a gear rack and a pinion may be applicable thereto and the same effect may be obtained.

Further, a description was provided of an example in which the center for executing the belt steering function as the moving unit was set on the F side, and the steering was executed on the R side, but the invention is not limited thereto, and even in a case where the steering is executed on the F side or on both the F and R sides, the same effect may be obtained.

In addition, a description was provided of an example in which the endless belt was passed over two rollers including the tension roller and the support member such as the driving roller or the pressure roller. However, it is to be understood that the invention is not limited to the belt passing over the two rollers, and even in a structure in which the belt is passing over three of more rollers, the present invention may be applicable without any problems and the same effect may be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-285694, filed Nov. 2, 2007, which is hereby incorporated by reference herein in its entirety.

What is claimed is:

1. A conveyor-belt apparatus, comprising:

a belt;

a supporting member that rotatably supports the belt;

a moving unit that displaces at least one end of the supporting member in a longitudinal direction to move the belt in the longitudinal direction; and a tension changing unit that changes the tension of the belt in accordance with the moving state of the belt in the longitudinal direction when the moving unit displaces the at least one end of the supporting member.

2. A conveyor-belt apparatus according to claim 1, wherein the tension changing unit changes the tension of the belt in accordance with the movement speed of the belt in the longitudinal direction when the end of the supporting member is displaced.

3. A conveyor-belt apparatus according to claim 1, wherein the tension changing unit changes the tension of the belt in accordance with the movement direction of the belt in the longitudinal direction when the end of the supporting member is displaced.

4. A conveyor-belt apparatus according to claim 1, wherein the belt rotates, the apparatus further comprising a stopping unit that stops the rotation of the belt in accordance with the moving state of the belt in the longitudinal direction when the tension is changed by the tension changing unit.

5. A conveyor-belt apparatus according to claim 1, wherein the tension changing unit changes, in the longitudinal direction, the tension of the belt on one end side of the belt and the tension of the belt on the other end side of the belt, respectively.

6. A conveyor-belt apparatus according to claim 1, wherein the tension changing unit makes the tension of the belt on one end side of the belt on which the belt is moved by an operation of the moving unit smaller than the tension of the belt on the other end side of the belt.

7. An image heating apparatus, comprising:

a belt that heats a toner image on a recording material;

a supporting member that rotatably supports the belt;

a moving unit that displaces at least one end of the supporting member in a longitudinal direction to move the belt in the longitudinal direction; and a tension changing unit that changes the tension of the belt in accordance with the moving state of the belt in the longitudinal direction when the moving unit displaces the end of the supporting member.

8. An image heating apparatus according to claim 7, wherein the tension changing unit changes the tension of the belt in accordance with the movement speed of the belt in the longitudinal direction when the end of the supporting member is displaced.

9. An image heating apparatus according to claim 7, wherein the tension changing unit changes the tension of the belt in accordance with the movement direction of the belt in the longitudinal direction when the end of the supporting member is displaced.

10. An image heating apparatus according to claim 7, wherein the belt rotates, the apparatus further comprising a stopping unit that stops a rotation of the belt in accordance with the moving state of the belt in the longitudinal direction when the tension is changed by the tension changing unit.

11. An image heating apparatus according to claim 7, wherein the tension changing unit changes, in the longitudinal direction, the tension of the belt on one end side of the belt and the tension of the belt on the other end side of the belt, respectively.

12. An image heating apparatus according to claim 7, wherein the tension changing unit makes the tension of the belt on one end side of the belt on which the belt is moved by an operation of the moving unit smaller than the tension of the belt on the other end side of the belt.

* * * * *